United States Patent [19]

Ouchi

[11] Patent Number: 4,568,923

[45] Date of Patent: Feb. 4, 1986

[54] FIRE ALARM SYSTEM

[75] Inventor: Hiroshi Ouchi, Kawasaki, Japan

[73] Assignee: Nittan Company, Limited, Tokyo, Japan

[21] Appl. No.: 463,383

[22] Filed: Feb. 3, 1983

[30] Foreign Application Priority Data

Feb. 4, 1982 [JP] Japan ..... 57-015527

[51] Int. Cl.[4] ..... G08B 17/00

[52] U.S. Cl. ..... 340/584; 340/508

[58] Field of Search ..... 340/584, 587, 506, 507, 340/508, 521, 517

[56] References Cited

U.S. PATENT DOCUMENTS

| | | | |
|---|---|---|---|
| 2,684,475 | 7/1954 | Lode | 340/508 |
| 3,832,678 | 8/1974 | Gysell et al. | 340/587 |
| 4,247,848 | 1/1981 | Kitta et al. | 340/584 |

FOREIGN PATENT DOCUMENTS

| | | | |
|---|---|---|---|
| 2101784 | 6/1982 | United Kingdom | 340/506 |

*Primary Examiner*—James L. Rowland

*Assistant Examiner*—Jeffery A. Hofsass

*Attorney, Agent, or Firm*—Abelman, Frayne Rezac & Schwab

[57] ABSTRACT

There is disclosed a fire alarm system wherein a plurality of fire detectors are connected to each alarm line and a light emission diode is connected in series between an alarm line and an electric source, said light emission diode indicating the actuation of any of the fire detectors, said system being capable of monitoring the alarm lines for breakage or disconnection without interruption of its fire monitoring function. This fire alarm system comprises a pulse oscillator; a switching circuit; a voltage detection circuit; two light emission diodes; a delay circuit; means for forcibly turning on the switching circuit; a capacitor; and a high resistance resistor. This fire alarm system is so constructed that the breakage or disconnection of an alarm line is indicated by the on-and-off flashing of one light emission diode, that the occurrence of a fire is indicated by the continuous glow of the two light emission diodes, and that extinguishment of the fire is indicated by the putting out of one of the two light emission diodes.

4 Claims, 2 Drawing Figures

FIRE ALARM SYSTEM

BACKGROUND OF THE INVENTION

The present invention relates to a fire alarm system, and more particularly to a fire alarm system in which a plurality of fire detectors are connected to each of the alarm lines which are extended from a central monitoring station to monitoring sections, said fire detectors short-circuiting the alarm lines with low impedance when any fire detector detects a fire, and the signal from any of the fire detectors is optically displayed by means of light emitting diodes or the like.

In conventional systems of this type, an accidental disconnection or a failure in the wiring is detected by monitoring the level of the current which flows through a resistor which is connected to the distal end of each alarm line. This system has a defect in that extra electric power is consumed for such failure detecting operation. Recently, many high and very large buildings, and other structures are being built, so that extensive sections have to be monitored and the number of required alarm lines inevitably has to be increased. Under the circumstances, the above-mentioned defect of conventional fire alarm systems is no longer negligible.

To diminish the above defect, there is known a method wherein a diode is connected in series with the above-stated resistor so that normally no current flows, and a voltage of the reverse polarity is applied to the alarm lines only when the lines are to be tested for disconnection or breakage. However, even this method has defects in that it is impossible to constantly monitor the wiring for breakage and disconnection, and that fire detectors of some types may be broken by the voltage of reverse polarity.

It is, therefore, the object of the present invention to provide a fire alarm system in which disconnection in the wiring can be monitored all the time with less consumption of electric power.

DISCLOSURE OF THE INVENTION

This invention provides in a fire alarm system comprising alarm lines to each of which a plurality of fire detectors are connected wherein a light emitting diode is connected in series between an alarm line and the electric source, said light emission diode indicating the actuation of any of the fire detectors, the improved fire alarm system which comprises: (1) a pulse oscillator; (2) a switching circuit which is connected in series between said power source and said first light emission diode and is turned "off" by an output pulse from said pulse oscillator; (3) a voltage detection circuit for detecting a voltage drop in said alarm lines; (4) a second light emission diode which is made to glow by the output of said voltage detection circuit; (5) a delay circuit which is turned "on" after a certain delay time by the output of said voltage detection circuit; (6) means for forcibly turning "on" said switching circuit by an output of said delay circuit; (7) a capacitor connected to the distal end of each alarm line; and (8) a high resistance resistor which connects each alarm line to the grounded negative side of said power source.

BRIEF DESCRIPTION OF THE DRAWINGS

The invention will now be specifically described with reference to the attached drawings in which.

DESCRIPTION OF PREFERRED EMBODIMENTS

Figure 1:
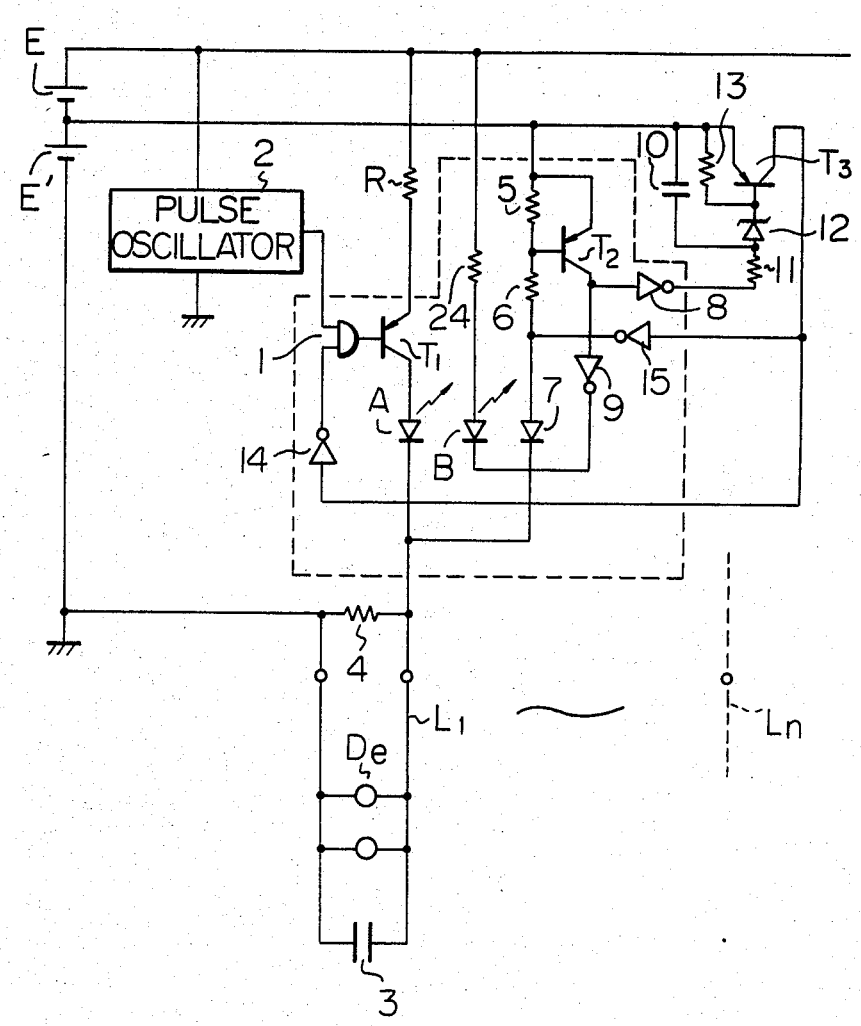
FIG. 1 is a circuit diagram of an embodiment of the present invention.

FIG. 1 shows a circuit diagram of an embodiment of the present invention. The voltage of a power source E is sent out on an alarm line $L_1$ through a protection resistor R and a switching circuit consisting of a transistor $T_1$ and a first light emitting diode A. The transistor $T_1$ is connected at its base to the output terminal of an AND gate 1, and this transistor $T_1$ is normally set "on". A plurality of fire detectors $D_e$ are connected to the alarm line $L_1$. Any detector is short-circuited when it detects a fire and the light emitting diode A glows to alarm the operator of the fire. A pulse oscillator 2 is provided and its pulses are constantly input to one of the input terminals of the AND gate 1. The other input terminal thereof is set to be constantly at high level as explained later, and therefore the above-mentioned pulses are applied to the base of the transistor $T_1$. The transistor $T_1$ is turned "off" when the pulses are applied thereto, so that supply of the voltage to the alarm line $L_1$ is cut off. However, since a capacitor 3 is connected at the distal end of the alarm line $L_1$, the voltage charged thereon enables the detector $D_e$ to continue monitoring operation under the normal condition. On the other hand, the alarm line $L_1$ is connected to the negative (grounded) side of the power source E through a high resistance resistor 4, so that if the alarm line $L_1$ is broken, the voltage of the alarm line $L_1$ becomes low level corresponding to the above-mentioned pulses. This circuit is further provided with another power source E′ whose voltage is lower than that of the main power source E. From the power source E′ a current flows into the high resistance resistor 4 through resistors 5 and 6 and a diode 7. Another transistor $T_2$ is provided so that the emitter thereof is connected to the power source E′, and the base thereof is connected to the junction of the resistors 5 and 6. This transistor is turned "on" when the current flows through resistors 5 and 6. When the transistor $T_2$ is turned "on", the voltage of the power source E′ is applied to inverters 8 and 9 through the emitter and collector of the transistor $T_2$. Thus, the outputs of the inverters 8 and 9 are at low level. In this embodiment, the resistors 5 and 6, the diode 7, the transistor $T_2$, etc. compose a voltage detection circuit. When the output of the inverter 9 becomes low level, the cathode of a second light emitting diode B connected to the power source E through a resistor 24 also becomes low level, and this causes the second light emission diode B to glow only during the aforementioned pulse periods. Therefore, disconnection of the alarm line $L_1$ allows the light emission diode B to glow in response to the above pulses, namely, it flashes on-and-off for indication. While the alarm line $L_1$ is in the normal state, since the voltage charged in the capacitor 3 is larger than that of the power source E′, the diode 7 is biased inversely to be turned "off", so that the light emitting diode B does not flash.

When a fire detector $D_e$ detects a fire and short-circuits the alarm line, the voltage of the alarm line $L_1$ becomes low level, so that the transistor $T_2$ is turned "on" in the same way as previously described and the light emitting diode B glows. However, in this case, the alarm line $L_1$ remains at low level continuously, so that the light emission diode B glows continuously. Furthermore, the output of the inverter 8 is continuously at low level, and a capacitor 10 connected to the power source E' is charged to more than a predetermined voltage through a resistor 11 connected between the capacitor 10 and the inverter 8, after a certain period of time, whereby a Zener diode 12 is turned "on". A serial connection circuit consisting of the Zener diode 12 and a resistor 13 is connected to the power source E' in parallel with the capacitor 10. The emitter and the base of a transistor $T_3$ are connected across the resistor 13. Thus, the transistor $T_3$ is turned "on" by conduction of the Zener diode 12. The capacitor 10, resistors 11 and 13, Zener diode 12, and transistor $T_3$ compose a delay circuit. When the transistor $T_3$ is turned "on", its collector becomes high level, so that the outputs of inverters 14 and 15 which are connected thereto are both at low level. The output of the inverter 14 is connected to the other input terminal of the afore-mentioned AND gate 1, so that the AND gate 1 is closed due to the low-level output of the inverter 14. Therefore, the output pulse of the afore-stated pulse oscillator 2 is not applied to the transistor $T_1$, and the transistor $T_1$ is continuously "on". The AND gate 1 serves to forcibly turn on the switching circuit described previously by way of the output of the above-mentioned delay circuit. Due to this, the light emitting diode A glows continuously to indicate the occurrence of a fire. On the one hand, the low-level output of the inverter 15 keeps the transistor $T_2$ "on" continuously, so that the light emitting diode B also lights continuously due to the output of the inverter 9. That is to say, when a fire occurs, both light emitting diodes A and B glow continuously. Although the brightness of light emitting diodes is generally lower than that of display lamps or the like, in this embodiment, since two light emitting diodes described above are disposed adjacent to each other in the same display window, the combined light emitted thereby produces a bright clear display.

Then, when the fire has been put out and the short-circuited detector $D_e$ is open again, the light emitting diode A turns off, but the light emitting diode B does not. This is because the transistor $T_2$ is automatically maintained "on" due to the output of the inverter 15. In this manner, the operator can know that the fire has been put out.

Needless to say, the same alarm operation as described above for the alarm line $L_1$ is performed for the other alarm lines $L_2$, $L_3$, - - - , $L_n$. The circuits enclosed by broken line must be provided for each alarm line.

Figure 2:
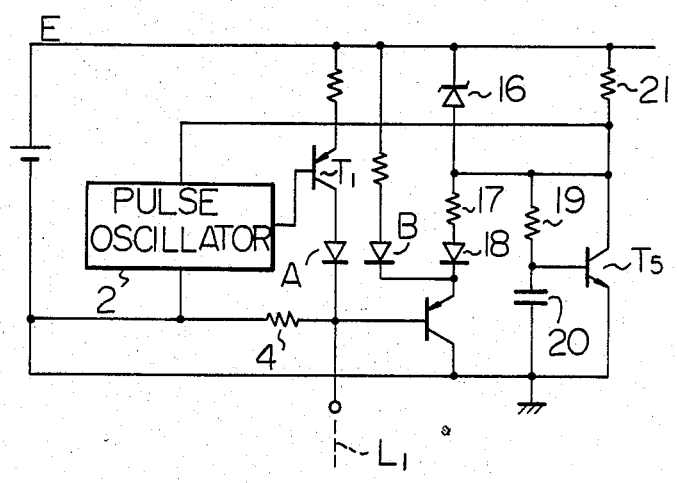
FIG. 2 is a circuit diagram of another embodiment of the present invention.

FIG. 2 shows another embodiment of the present invention. In this embodiment, the output pulses of the pulse oscillator 2 are directly connected to the base of the transistor $T_1$. A voltage detection circuit for detecting the voltage drop in the alarm line $L_1$ is constructed of a serial connection circuit comprising a Zener diode 16, a resistor 17, a diode 18, and the emitter and base of a transistor $T_4$. The voltage of the alarm line $L_1$ is applied to the base of the transistor $T_4$. When a voltage drop larger than a prescribed level occurs in the alarm line $L_1$, both Zener diode 16 and the transistor $T_4$ are turned "on". The second light emitting diode B which is connected between the power source E and the emitter of the transistor $T_4$ glows when the transistor $T_4$ is turned "on". A capacitor 20 and the base of a transistor $T_5$ are connected to the junction of the Zener diode 16 and the resistor 17 through a resistor 19, and the other end of the capacitor 20 is grounded. The emitter of the transistor $T_5$ is also grounded, while the collector thereof is connected to the power supply terminal of the pulse oscillator 2 and also to the power source E through a resistor 21. The resistor 19, capacitor 20, transistor $T_5$, etc. compose a delay circuit which is turned "on" after a certain delay time by the output of the above-stated voltage detection circuit. This delay circuit also serves to forcibly turn "on" the transistor $T_1$ by stopping the power supply from the above-mentioned pulse oscillator 2 when the delay circuit is "on".

Electric power is ordinarily supplied to the pulse oscillator 2 through the resistor 21, and the pulses are generated thereby. The transistor $T_1$ is turned "on" or "off" in response to the above pulses. However, upon occurrence of a fire, the alarm line $L_1$ is short-circuited so that the light emitting diode A glows, the transistor $T_4$ is turned "on", and the light emitting diode B also glows. When the transistor $T_5$ is turned "on" after a prescribed delay time, the pulse oscillator 2 stops generating pulses, and the transistor $T_1$ is forcibly kept "on" continuously. Namely, both light emitting diodes A and B glow continuously.

On the other hand, when the alarm line $L_1$ becomes disconnected or broken, the transistor $T_1$ is turned "off" only during the pulse periods of the output from the pulse oscillator 2, resulting in a voltage drop in the alarm line $L_1$, so that the Zener diode 16 and the transistor $T_4$ are turned "on", and the light emission diode B flashes on-and-off in response to the pulses. This pulse time pulse width is so short that the transistor $T_5$ is not turned "on". In this manner, the same operation as that of the first embodiment is performed and a similar effect can be achieved.

As described in the foregoing, in accordance with the present invention, the electric power sent out on the alarm line is intermittently stopped, the alarm line operates during such stop periods utilizing the voltage charged in the capacitor connected thereto and the second light emitting diode flashes on and off, upon detection of the voltage drop of the alarm line, and when the voltage drop in the alarm line continues longer than a certain time, the sending of the electric power which has been stopped intermittently is caused to resume by the output of the delay circuit and the electric power is then sent out continuously. Therefore, it is possible to monitor the alarm lines for disconnection or breakage by the on-and-off flashing of the second light emitting diode. On one hand, upon occurrence of a fire, since two light emitting diodes glow simultaneously and continuously, the brightness is doubled so that a distinct display is provided. The monitoring of the alarm lines for disconnection or breakage requires less consumption of electric power, and the uninterrupted monitoring for fire is possible. Therefore, there is no failure in monitoring for occurrence of fire due to wiring disconnection and thus the reliability of the fire alarm system is improved.

Although preferred embodiments of the invention are specifically illustrated and described herein, it will be appreciated that many modifications and variations of the present invention are possible in light of the above teachings and within the purview of the appended claims without departing from the spirit and intended scope of the invention.

I claim:

1. In a fire alarm system comprising alarm lines to each of which a plurality of fire detectors are connected wherein a light emitting diode is connected in series between an alarm line and the electric source, said light emission diode indicating the actuation of any of the fire detectors, the improved fire alarm system which comprises:

(1) a pulse oscillator;

(2) a switching circuit which is connected in series between said power source and said first light emission diode and is turned "off" by an output pulse from said pulse oscillator;

(3) a voltage detection circuit for detecting a voltage drop in said alarm lines;

(4) a second light emission diode which is made to glow by the output of said voltage detection circuit;

(5) a delay circuit which is turned "on" after a certain delay time by the output of said voltage detection circuit;

(6) means for forcibly turning "on" said switching circuit by an output of said delay circuit;

(7) a capacitor connected to the distal end of each alarm line; and (8) a high resistance resistor which connects each alarm line to the grounded negative side of said power source.

2. The fire alarm system as claimed in claim 1, wherein said first light emission diode connected in series between said alarm line and said power source and said second light emission diode are disposed adjacent to each other in the same display window.

3. The fire alarm system as claimed in claim 1 or 2, wherein the means for forcibly turning "on" said switching circuit by the output of the delay circuit comprises the AND gate connected to the output of the pulse oscillator and an inverter which closes said AND gate by the output of the delay circuit.

4. The fire alarm system as claimed in claim 1 or 2, wherein the means for forcibly turning "on" said switching circuit by the output of the delay circuit is constructed so that voltage supply to the pulse oscillator is cut off by the output of the delay circuit.

* * * * *